US009335680B2

(12) United States Patent
Kaneko et al.

(10) Patent No.: US 9,335,680 B2
(45) Date of Patent: May 10, 2016

(54) IMAGE FORMING APPARATUS HAVING FIXING DEVICE THAT RESPONDS TO REQUEST WHEN USING DECOLORABLE INK

(71) Applicants: KABUSHIKI KAISHA TOSHIBA, Tokyo (JP); TOSHIBA TEC KABUSHIKI KAISHA, Tokyo (JP)

(72) Inventors: Yoshiaki Kaneko, Shizuoka (JP); Minoru Yoshida, Tokyo (JP); Osamu Takagi, Tokyo (JP); Takahito Kabai, Shizuoka (JP); Hiroyuki Taguchi, Shizuoka (JP); Ken Iguchi, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/581,744

(22) Filed: Dec. 23, 2014

(65) Prior Publication Data

US 2015/0110512 A1 Apr. 23, 2015

Related U.S. Application Data

(63) Continuation of application No. 13/627,640, filed on Sep. 26, 2012, now Pat. No. 8,953,965, which is a continuation-in-part of application No. 13/099,265, filed on May 2, 2011, now Pat. No. 8,290,386, which is (Continued)

(51) Int. Cl.

| | |
|---|---|
| ***G03G 15/20*** | (2006.01) |
| ***B41J 29/38*** | (2006.01) |
| ***G03G 15/10*** | (2006.01) |

(52) U.S. Cl.

CPC ..... *G03G 15/2039* (2013.01); *B41J 29/38* (2013.01); *G03G 15/10* (2013.01); *G03G 15/205* (2013.01); *G03G 15/2032* (2013.01); *G03G 15/2067* (2013.01); *G03G 15/2078* (2013.01); *G03G 2215/20* (2013.01)

(58) Field of Classification Search

USPC ..... 399/38, 67–69, 107, 110, 122, 127

See application file for complete search history.

(56) References Cited

U.S. PATENT DOCUMENTS

| | | | |
|---|---|---|---|
| 4,833,488 | A | 5/1989 | Mizutani et al. |
| 5,394,231 | A | 2/1995 | Sudo et al. |

(Continued)

FOREIGN PATENT DOCUMENTS

| | | | |
|---|---|---|---|
| JP | H06095494 | A | 4/1994 |
| JP | H10088046 | A | 4/1998 |

(Continued)

*Primary Examiner* — Hoan Tran

(74) *Attorney, Agent, or Firm* — Patterson & Sheridan, LLP

(57) ABSTRACT

An image forming apparatus includes: a first image forming unit which forms a first image on a first recording medium with a first material that is not thermally decolorizable; a second image forming unit which forms a second image on a second recording medium with a second material that is thermally decolorizable; a fixing device which is on a common carrying path shared by the first recording medium and the second recording medium and fixes the first image to the first recording medium; and a controller which controls the fixing device so that a temperature of the fixing device is lower than a decolorizing temperature of the second material when the second recording medium reaches the fixing device.

18 Claims, 4 Drawing Sheets

Related U.S. Application Data a continuation of application No. 12/704,832, filed on Feb. 12, 2010, now Pat. No. 7,957,660.

(60) Provisional application No. 61/153,207, filed on Feb. 17, 2009.

(56) References Cited

U.S. PATENT DOCUMENTS

| | | | | | |
|---|---|---|---|---|---|
| 5,572,311 | A | * | 11/1996 | Abe et al. | 399/127 |
| 5,922,115 | A | | 7/1999 | Sano et al. | |
| 6,017,386 | A | | 1/2000 | Sano et al. | |
| 6,203,603 | B1 | | 3/2001 | Takayama et al. | |
| 6,596,669 | B1 | | 7/2003 | Maruyama et al. | |
| 7,567,767 | B2 | | 7/2009 | Kikuchi | |
| 8,615,177 | B2 | | 12/2013 | Iguchi et al. | |
| 2007/0072771 | A1 | | 3/2007 | Gotanda et al. | |
| 2007/0072773 | A1 | | 3/2007 | Takayama et al. | |
| 2008/0261143 | A1 | | 10/2008 | Yamashita | |
| 2011/0294052 | A1 | | 12/2011 | Aoki et al. | |
| 2012/0269548 | A1 | | 10/2012 | Yamashita | |

FOREIGN PATENT DOCUMENTS

| | | | |
|---|---|---|---|
| JP | 2007090704 | A | 4/2007 |
| JP | 2007212613 | A | 8/2007 |

* cited by examiner

IMAGE FORMING APPARATUS HAVING FIXING DEVICE THAT RESPONDS TO REQUEST WHEN USING DECOLORABLE INK

CROSS-REFERENCE TO RELATED APPLICATION

This application is a continuation of U.S. patent application Ser. No. 13/627,640 filed Sep. 26, 2012, which is a continuation-in-part of U.S. patent application Ser. No. 13/099,265 filed May 2, 2011, now U.S. Pat. No. 8,290,386, which is a continuation of U.S. patent application Ser. No. 12/704,832 filed Feb. 12, 2010, now U.S. Pat. No. 7,957,660, which is based upon and claims the benefit of priority from Provisional U.S. Application 61/153,207 filed on Feb. 17, 2009. The entire contents of the foregoing applications are incorporated herein by reference.

TECHNICAL FIELD

The present invention relates to an image forming apparatus having an image forming unit which forms a thermally non-decolorable image, and an image forming unit which forms a thermally decolorable image.

BACKGROUND

Recently, as an image forming apparatus that forms an image on a recording medium, there is an apparatus that thermally decolorizes an image formed on a sheet and then forms a new image on the same sheet, in order to reuse sheets, save paper resources and thus realize environment protection. For example, JP-A-10-88046 discloses a printer that includes an image forming unit using a decolorable ink and a decolorizing unit which decolorizes an image formed by the image forming unit, within the single apparatus. Moreover, as an image forming apparatus, there is an apparatus including an image forming function to form an image with a decolorable image forming material and an image forming function to form an image with a non-decolorable image forming material, within the single apparatus, in order to realize multiple functions. For example, JP-A-6-95494 discloses an image forming apparatus including a developing device which performs development with an ordinary toner and a developing device which performs development with an optically decolorable toner, within the same apparatus.

However, when an electrographic image forming function to heat and fix a toner image formed on a sheet by a fixing device and an ink jet image forming function using a decolorable ink that is thermally decolorable are provided within the same apparatus, it is necessary to prevent the decolorable ink from being affected by heat. As the sheet carrying path is divided between the electrographic system and the ink jet system in order to detour a sheet used in the ink jet system so that the sheet does not pass through the fixing device, the carrying path becomes complex and may obstruct miniaturization.

Thus, it is desired that an image forming apparatus should be developed which has plural image forming functions within the same apparatus and in which an image formed with a decolorable image forming material is prevented from being affected by heat and the sheet carrying path can be simplified.

SUMMARY

According to an embodiment, an image forming apparatus includes: a first image forming unit which forms a first image on a first recording medium with a first material that is not thermally decolorizable; a second image forming unit which forms a second image on a second recording medium with a second material that is thermally decolorizable; a fixing device which is on a common carrying path shared by the first recording medium and the second recording medium and fixes the first image to the first recording medium; and a controller which controls the fixing device so that a temperature of the fixing device is lower than a decolorizing temperature of the second material when the second recording medium reaches the fixing device

DETAILED DESCRIPTION

Figure 1:
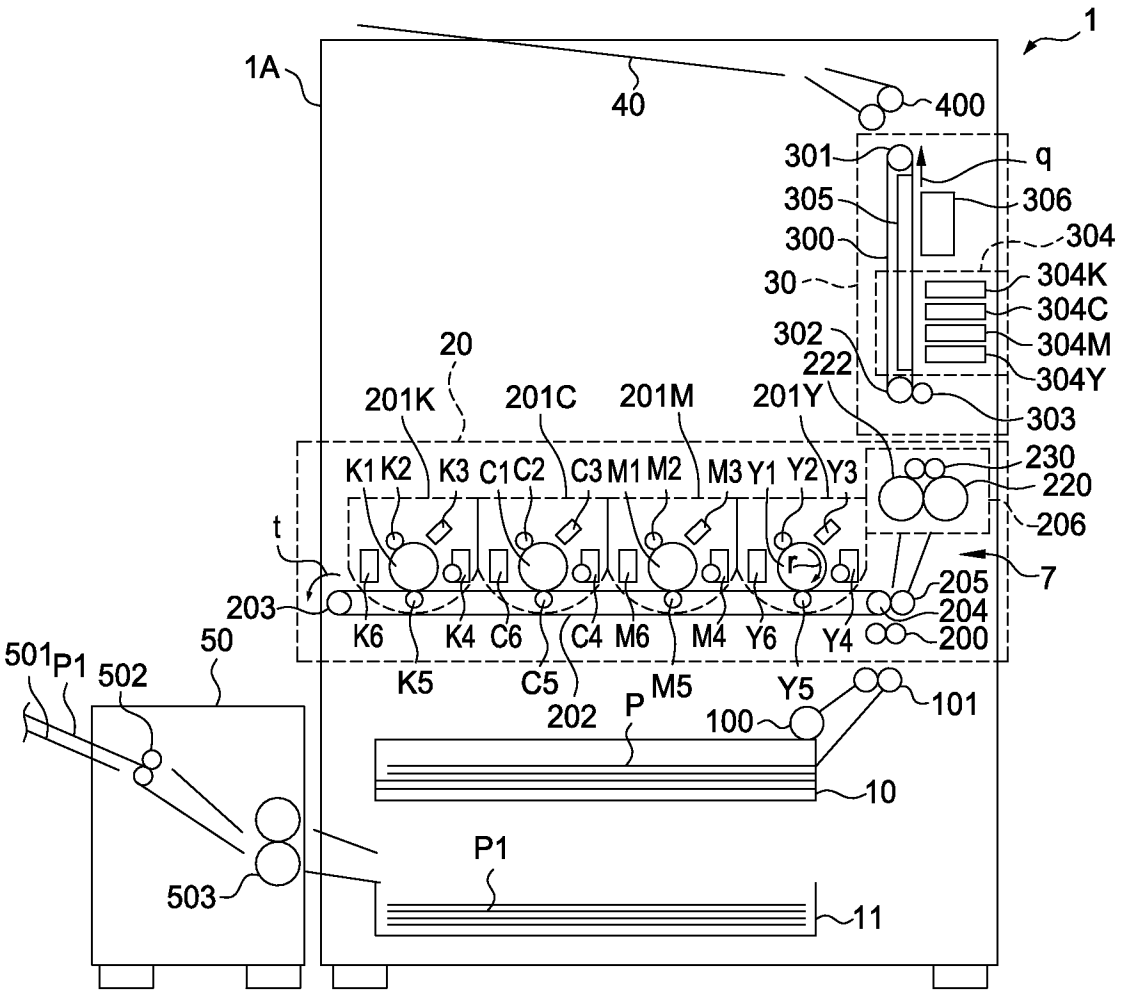
FIG. 1 is a schematic view of a configuration showing an image forming apparatus and a decolorization apparatus according to an embodiment.

Hereinafter, an embodiment will be described. FIG. 1 is a schematic view of configuration showing an image forming apparatus 1 and a decolorization apparatus 50 according to the embodiment of the invention. The image forming apparatus 1 is of a hybrid type and has a first printer 20 as a first image forming unit and a second printer 30 as a second image forming unit, within a body 1A. The first printer 20 is an electrographic color printer and forms a first image using a toner as a first material which is not thermally decolorized. The second printer 30 is an ink jet color printer and forms a second image using a decolorable ink as a second material which is thermally decolorized.

The image forming apparatus 1 has a cassette 10 that supplies a sheet P as a first recording medium or a second recording medium. The first recording medium is a sheet on which an image is formed by the first printer 20. The second recording medium is a sheet on which an image is formed by the second printer 30. The image forming apparatus 1 has a paper discharge roller pair 400 which discharges the sheet P passed through the first printer 20 and the second printer 30, and a paper discharge tray 40. In a carrying path 7 that is a common carrying path from the cassette 10 to the first printer 20 or the second printer 30 in the body 1A, a pickup roller 100 which takes the sheet P out of the cassette 10, a carrying roller pair 101 and a registration roller pair 200 are provided. The image forming apparatus 1 has, on the carrying path 7, a fixing device 206 as a fixing unit which fixes a toner image formed by the first printer 20 to the sheet P. The image forming apparatus 1 has, below the cassette 10, a box 11 which collects sheets P1 for reuse carried from the decolorization apparatus 50.

The decolorization apparatus 50 is a heat roller-type decolorization apparatus for heating and thus decolorizing an ink image formed once with a decolorable ink that is thermally decolorable. The decolorization apparatus 50 has a paper supply tray 501 on which a sheet P1 having an ink image thereon is placed, a supply roller pair 502 which supplies the sheet P1 on the paper supply tray 501, and a decolorizing roller pair 503 which heats and guides the sheet P1 to the box 11. The decolorizing roller pair 503 holds a temperature equal to or higher than the decolorizing temperature of the decolorable ink, for example, 100° C.

The first printer 20 has four image forming stations 201Y, 201M, 201C and 201K for Y (yellow), M (magenta), C (cyan) and K (black) arranged in parallel along an intermediate transfer belt 202. A driving roller 203 and a supporting roller 204 support the intermediate transfer belt 202.

The yellow (Y) image forming station 201Y of the first printer 20 has, around a photoconductive drum Y1, a charging roller Y2 which uniformly charges the photoconductive drum Y1, an exposure device Y3 which forms an electrostatic latent image on the photoconductive drum Y1, a developing device Y4 which develops the electrostatic latent image on the photoconductive drum Y1, a primary transfer roller Y5 which performs primary transfer of the toner image on the photoconductive drum Y1 to the intermediate transfer belt 202, and a photoconductor cleaner Y6. The image forming stations 201M, 201C and 201K for magenta (M), cyan (C) and black (K) have the similar structure as that of the yellow (Y) image forming station 201Y though the toner type is different. Therefore, the common parts of the structure are denoted by the same reference numerals as in the structure of the yellow (Y) image forming station 201Y together with their respective color symbols, and will not be described further in detail.

The magenta (M) image forming station 201M has, around a photoconductive drum M1, a charging roller M2, an exposure device M3, a developing device M4, a primary transfer roller M5 and a photoconductor cleaner M6. The cyan (C) image forming station 201C has, around a photoconductive drum C1, a charging roller C2, an exposure device C3, a developing device C4, a primary transfer roller C5 and a photoconductor cleaner C6. The black (K) image forming station 201K has, around a photoconductive drum K1, a charging roller K2, an exposure device K3, a developing device K4, a primary transfer roller K5 and a photoconductor cleaner K6. The developing devices Y4, M4, C4 and K4 perform development using a thermally non-decolorable toner.

The first printer 20 has a secondary transfer roller 205 which transfers the toner images formed by the image forming stations 201Y, 201M, 201C and 201K and primary-transferred to the intermediate transfer belt 202, simultaneously to the sheet P. The secondary transfer roller 205 is separated from the intermediate transfer belt 202 at the time of printing by the second printer 30.

Each of the image forming stations 201Y, 201M, 201C and 201K is formed as a unit and is integrally attachable to and removable from the body 1A and thus replaceable, independently of each other. Moreover, the first printer 20 is formed as a unit and is integrally attached to and removed from the body 1A. In the image forming apparatus 1, the first printer 20 can be replaced with another unit, for example, a monochrome-only unit in response to a user's request.

The fixing device 206 has a movable heat roller 222 as a heat member, a fixed press roller 220 as a press member, and a relay roller pair 230 as a relay part.

Figure 2:
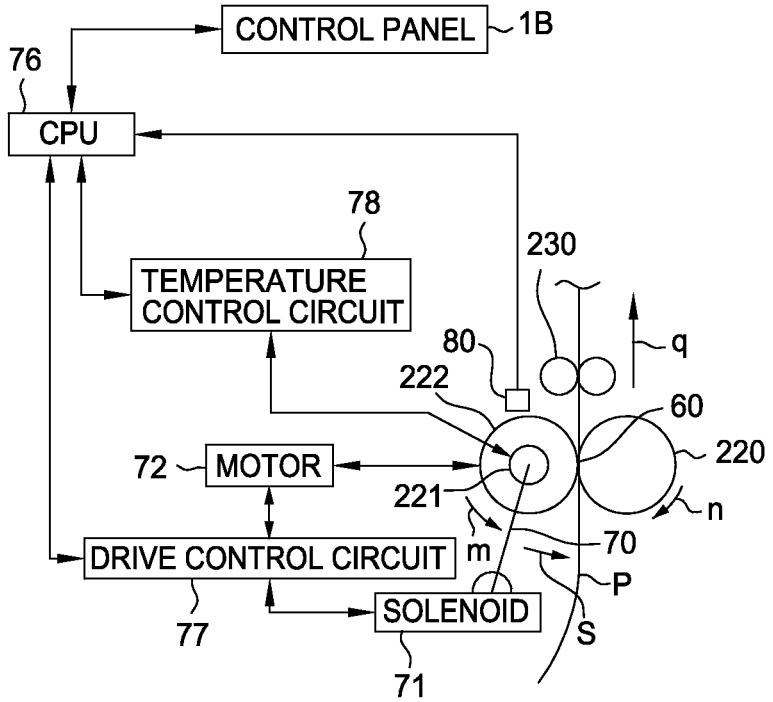
FIG. 2 is a schematic view of a configuration showing pressurized contact between a heat roller and a press roller according to the embodiment.

The heat roller 222 has a heat lamp 221 inside, as shown in FIG. 2, and contacts a toner image on the sheet P. The heat lamp 221 provides the heat roller 222 with necessary heat for fixing the toner image. The heat roller 222 has, for example, an elastic rubber layer around a core metal containing the heat lamp 221 inside, and has a release layer on the surface. The press roller 220 has, for example, a solid rubber layer around a core metal and has a release layer on the surface. As the movable heat roller 222 pressurizes and contacts the press roller 220, the surface of the heat roller 222 elastically deforms and a nip 60 having a predetermined contact width is formed between the heat roller 222 and the press roller 220. As the sheet P passes through the nip 60, the toner image on the sheet P is fixed by being heated and pressurized.

Figure 3:
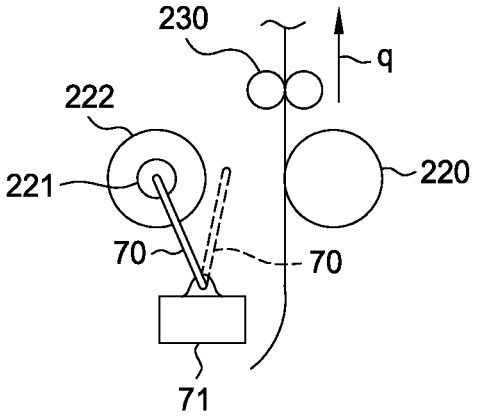
FIG. 3 is a schematic view of a configuration showing separation of the heat roller from the press roller according to the embodiment.

An arm 70 supporting the heat roller 222 slides the heat roller 222 when turning. A solenoid 71 turns the arm 70. For example, when the solenoid 71 is turned on with positive polarity, the arm 70 is at the position shown in FIG. 2 and presses the heat roller 222 toward the press roller 220. The press roller 220 and the heat roller 222 are pressurized and contact each other. When the solenoid 71 is turned off, the arm 70 is at the position indicated by the dotted line in FIG. 3 and the press roller 220 and the heat roller 222 lightly contact each other. When the solenoid 71 is turned on with negative polarity, the arm 70 is at the position indicated by the solid line in FIG. 3 and the heat roller 222 is separated from the press roller 220.

A motor 72 rotates the heat roller 222 in the direction of arrow m. The press roller 220 follows the heat roller 222 and rotates in the direction of arrow n. A CPU 76 which controls the entire image forming apparatus 1 controls a drive control circuit 77 and a temperature control circuit 78. The result of detection by a sensor 80 which detects the surface temperature of the heat roller 222 is inputted to the CPU 76.

The drive control circuit 77 controls the solenoid 71 and the motor 72. When there is no designation of printing, the drive control circuit 77 controls the solenoid to OFF-state. The operator uses a control panel 1B to input whether printing is to be done by the first printer 20 or by the second printer 30, to the image forming apparatus 1. When the CPU 76 designates printing by the first printer 20 in accordance with the input on the control panel 1B, the drive control circuit 77 controls the solenoid 71 to ON-state with positive polarity. When the CPU 76 designates printing by the second printer 30 in accordance with the input on the control panel 1B, the drive control circuit 77 controls the solenoid 71 to ON-state with negative polarity.

The temperature control circuit 78 performs on-off control of the heat lamp 221 in accordance with the result of detection by the sensor 80. At the time of fixing the toner image, the temperature control circuit 78 performs on-off control of the heat lamp 221 so that the surface temperature of the heat roller 222 is maintained to, for example, 120° C.

The second printer 30 has ink jet heads 304Y, 304M, 304C and 304K for Y (yellow), M (magenta), C (cyan) and K (black) arranged in parallel along a carrying belt 300. A driving roller 301 and a driven roller 302 support the carrying belt 300. The carrying belt 300 has holes at predetermined intervals on the surface. The carrying belt 300 holds a negative-pressure chamber 305 inside. The negative-pressure chamber 305 sucks the sheet P to the carrying belt 300 via the holes in the carrying belt 300. The second printer 30 has a pressurizing roller 303 at the position facing the driven roller 302. The pressurizing roller 303 presses the sheet P to the carrying belt 300 and thus prevents the sheet P from floating on the carrying belt 300. The second printer 30 has a drier 306 which dries the ink image on the sheet P with warm air.

The ink jet heads 304Y, 304M, 304C and 304K eject color inks of Y (yellow), M (magenta), C (cyan) and K (black) that are decolorized by heat of, for example, 70°. In the yellow (Y) ink jet head 304Y, plural nozzles are arrayed at predetermined intervals, for example, across the maximum recording width of the sheet P, that is, 297 mm. The ink jet heads 304M, 304C and 304K for magenta (M), cyan (C) and black (K) have the similar structure to that of the yellow (Y) ink jet head 304Y.

A decolorable ink that is thermally decolorable is disclosed, for example, in JP-A-2007-212613, JP-A-2007-90704 and so on. The decolorable ink contains, for example, a coloration compound such as a leuco dye, a color developer, a binder resin having a decolorizing effect, and so on. At a temperature below the decolorizing temperature, the color of the decolorable ink can be recognized since the action of the color developer causes the coloration compound to develop color. When the decolorable ink is heated to the decolorizing temperature or higher, the softening of the binder resin causes the color developer in the binder resin to shift to the surface and is then diffused on the sheet P. The color developer no longer has its effect on the coloration compound. The coloration compound decolorizes. Therefore, the color of the decolorable ink cannot be recognized. The decolorizing temperature of the decolorable ink is adjusted by the material design of the coloration compound, color developer, binder resin and the like.

As the coloration compound, it is preferable to use an electron-donating organic material, for example, a leuco auramine, diaryl phthalide, polyaryl carbinol, acyl auramine, aryl auramine, rhodamine B, lactam, indoline, spiropyran, or fluoran.

As the color developer, it is preferable to use, for example, a phenol, metal phenolate, metal carboxylate, benzophenone, sulfonic acid, sulfonate, phosphate, metal phosphate, acid phosphate, acid metal phosphate, phosphorous acid, metal phosphite or the like.

The ink jet heads 304Y, 304M, 304C and 304K form an integrated cartridge 304, which is integrally attachable to and removable from the body 1A and is thus replaceable. The second printer 30 is formed as a unit and is integrally attached to and removed from the body 1A. The second printer 30 formed as a unit can be easily installed in the body 1A as an optional part in response to the user's request.

(1) Case where there is no designation of printing in the image forming apparatus 1

The image forming apparatus 1 is ready and the drive control circuit 77 turns off the solenoid 71. The press roller 220 and the heat roller 222 lightly contact each other. The heat roller 222 is held at a ready temperature.

(2) Case where printing is carried out by the first printer 20

At the start of printing, the drive control circuit 77 turns on the solenoid 71 with positive polarity in order to fix the toner image to the sheet by heating and pressurizing. The arm 70 is turned in the direction of arrow s. The heat roller 222 is pressed toward the press roller 220.

In the yellow (Y) image forming station 201Y, the photoconductive drum Y1 rotates in the direction of arrow r. The charging roller Y2 uniformly charges the photoconductive drum Y1. The exposure device Y3 casts exposure light corresponding to image information to the photoconductive drum Y1 and thus forms an electrostatic latent image on the photoconductive drum Y1. The developing device Y4 develops the electrostatic latent image with a thermally non-erasable ordinary toner and thus forms an yellow (Y) toner image as a first image that is not thermally erasable, on the photoconductive drum Y1. The primary transfer roller Y5 performs primary transfer of the toner image on the photoconductive drum Y1 to the transfer belt 202 turning in the direction of arrow t. After the primary transfer is finished, the photoconductor cleaner Y6 cleans the residual toner on the photoconductive drum Y1.

The magenta (M), cyan (C) and black (K) image forming stations 201M, 201C and 201K perform multiple transfer of magenta (M), cyan (C) and black (K) toner images onto the intermediate transfer belt 202, similarly to the yellow (Y) image forming station 201Y, and thus form a thermally non-decolorable color toner image.

The pickup roller 100 takes out the sheet P from the cassette 10. The carrying roller pair 101 and the registration roller pair 200 carry the sheet P to the secondary transfer roller 205 synchronously with the arrival of the color toner image on the intermediate transfer belt 202 at the secondary transfer roller 205. The secondary transfer roller 205 performs simultaneous secondary transfer of the color toner image on the intermediate transfer belt 202 to the sheet P. After that, as the sheet P reaches the fixing device 206, the heat roller 222 keeping the surface temperature of 120° C. and the press roller 220 nip and carry the sheet P within the nip 60 in the direction of arrow q and fix the color toner image to the sheet P by heating and pressurizing.

The relay roller pair 230, the carrying belt 300 and the paper discharge roller pair 400 carry the sheet P on which the fixed toner image is completed, in the direction of the arrow q, and discharge the sheet P to the paper discharge tray 40.

(3-1) Case where printing by the second printer 30 is carried out, for example, on a normal paper or thin paper with a weight of 40 to 180 g At the start of printing, the drive control circuit 77 turns on the solenoid 71 with negative polarity and separates the heat roller 222 from the press roller 220.

The pickup roller 100 takes out the sheet P from the cassette 10. The carrying roller pair 101 and the registration roller pair 200 carry the sheet P in the direction of the fixing device 206 through the gap between the intermediate transfer belt 202 and the secondary transfer roller 205. In the fixing device 206, the heat roller 222 slides away from the press roller 220 and is away from the carrying path 7 of the sheet P. In the fixing device 206, the sheet P carried by the registration roller pair 200 is carried in the direction of the second printer 30 by the relay rollers 230. While passing through the fixing device 206, the sheet P does not contact the heat roller 222. Therefore, the amount of heat transmitted from the heat roller 222 to the sheet P is small and the temperature of the sheet P is maintained below the decolorizing temperature of 70° C.

In the second printer 30, the pressurizing roller 303 presses the sheet P to the carrying belt 300. The sheet P is sucked to the carrying belt 300 in the negative-pressure chamber 305. The sheet P is thus carried in the direction of the arrow q by the carrying belt 300. The ink jet heads 304Y, 304M, 304C and 304K print ink images as second images that correspond to image information and thermally decolorize, in a superimposing manner on the sheet P traveling in the direction of the arrow q, and thus form a color ink image on the sheet P. At this time, the sheet P is maintained below 70° C. and therefore the ink image formed on the sheet P does not decolorize.

After that, the drier 306 dries, with warm air, the color ink image on the sheet P sucked to the carrying belt 300 and thus traveling in the direction of the arrow q. The paper discharge roller pair 400 discharges the sheet P on which the ink image is completed, to the paper discharge tray 40.

(3-2) Case where printing by the second printer 30 is carried out on a thick paper that is thicker than a normal paper At the start of printing, the drive control circuit 77 turns off the solenoid 71 and thus the press roller 220 and the heat roller 222 light contact each other.

A sheet P taken out of the cassette 10 passes through the carrying roller pair 101, the registration roller pair 200 and the space between the intermediate transfer belt 202 and the secondary transfer roller 205 and reaches the fixing device 206. In the fixing device 206, the sheet P passes between the heat roller 222 and the press roller 220, which lightly contact each other. The relay rollers 230 carry the sheet P in the direction of the second printer 30. While passing through the fixing device 206, the sheet P contacts the heat roller 222. However, since the sheet P is not pressurized by the heat roller 222 and press roller 220, the amount of heat transmitted to the sheet P is small. Also, the sheet P is a thick paper and has a large heat capacity. Therefore, the temperature of the sheet P is maintained below the decolorizing temperature of 70° C.

While printing is carried out in the image forming apparatus 1, the decolorization apparatus 50 decolorizes an ink image on the sheet P1 passing through the decolorizing roller pair 503. The decolorizing roller pair 503 heats the sheet P1 to 100° C. and thus decolorizes the ink image. The sheet P1 with its ink image decolorized is collected in the box 11. The operator reuses the sheet P1 collected in the box 11.

When, for example, the user does not need the second printer 30 at the time of installation, the image forming apparatus 1 may have the first printer 20 alone. The second printer 30 may be provided as an option when necessary.

According to this embodiment, at the time of printing by the first printer 20, the heat roller 222 is pressed toward the press roller 220 and a thermally non-decolorable color toner image is heated and pressurized and thus securely fixed to the sheet P passing through the nip 60. At the time of printing by the second printer 30, when a normal paper is handled, the heat roller 222 is separated away from the press roller 220 and the temperature of the sheet P passing through the fixing device 206 is maintained below the decolorizing temperature. The ink image formed with a decolorable ink can be securely prevented from decolorizing. Meanwhile, at the time of printing by the second printer 30, when a thick paper is handled, the heat roller 222 and the press roller 220 are made to lightly contact each other and the temperature of the sheet P passing through the fixing device 206 is maintained below the decolorizing temperature. The ink image formed with a decolorable ink can be securely prevented from decolorizing. Thus, the carrying path 7 can be shared by the first printer 20 which forms a thermally non-decolorable toner image and the second printer 30 which forms a thermally decolorable ink image. The structure of the image forming apparatus 1 can be simplified and a hybrid-type image forming apparatus which has a printer using an ordinary toner and a printer using a decolorable ink can be easily realized as a practical product.

The invention is not limited to the above embodiment and various changes and modifications can be made without departing from the scope of the invention. For example, the fixing temperature of the thermally non-decolorable toner or the decolorizing temperature of thermally decolorable ink is not limited. Also, in the embodiment, the position of the heat roller with respect to the press roller needs not be switched in three stages. The position of the heat roller with respect to the press roller may be switched in two stages, that is, the position where the heat roller pressurizes and contacts the press roller and the position where the heat roller moves away from the press roller.

Figure 4:
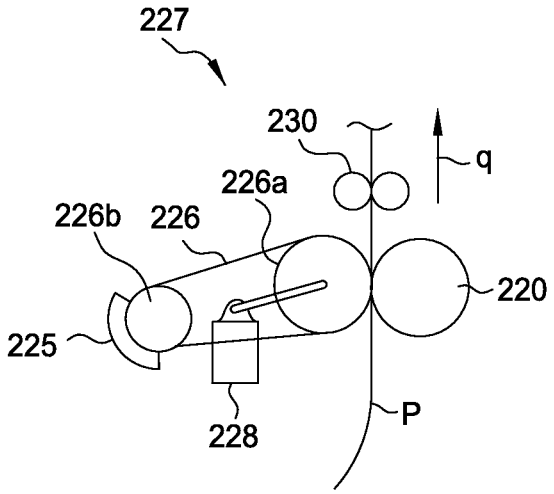
FIG. 4 is a schematic view of a configuration showing pressurized contact between a heat belt and a press roller according to another example.
Figure 5:
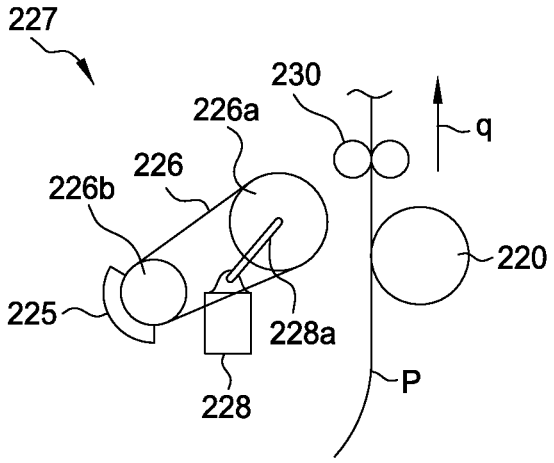
FIG. 5 is a schematic view of a configuration showing separation of the heat belt from the press roller according to the other example.

The structure of the fixing device is not limited, either. For example, as shown in the other example of FIG. 4 and FIG. 5, a belt fixing device 227 may be used to fix a thermally non-decolorable toner image. The belt fixing device 227 heats a heat belt 226 as a heat member to a fixing temperature, using an induction heating heater (IH heater) 225. For example, the heat belt 226 includes an electrically conductive thin metal base material with its surface covered with an elastic rubber layer, and a release layer covering the surface. The IH heater 225 adjusts the output of an induction coil and heats the heat belt 226 to the fixing temperature. In this other example, for example, an arm 228*a* supporting a driving roller 226*a* is turned by a solenoid 228 and the heat belt 226 is moved in contact with or away from the press roller 220. For example, in the case of printing a thermally non-decolorable toner image, the solenoid 228 is turned on and the heat belt 226 is pressed toward the press roller 220 as shown in FIG. 4, thus causing the heat belt 226 and the press roller 220 to pressurize and contact each other. In the case of printing a thermally decolorable ink image, the solenoid 228 is turned off and the heat belt 226 is separated away from the press roller 220 as shown in FIG. 5, thus reducing the amount of heat transmitted to the sheet passing through the belt fixing device 227. Also in the belt fixing device 227 of this other example, the sheet carrying path can be shared by the printer using an ordinary toner and the printer using a decolorable ink, and the sheet carrying path in the hybrid-type image forming apparatus can be simplified.

Figure 6:
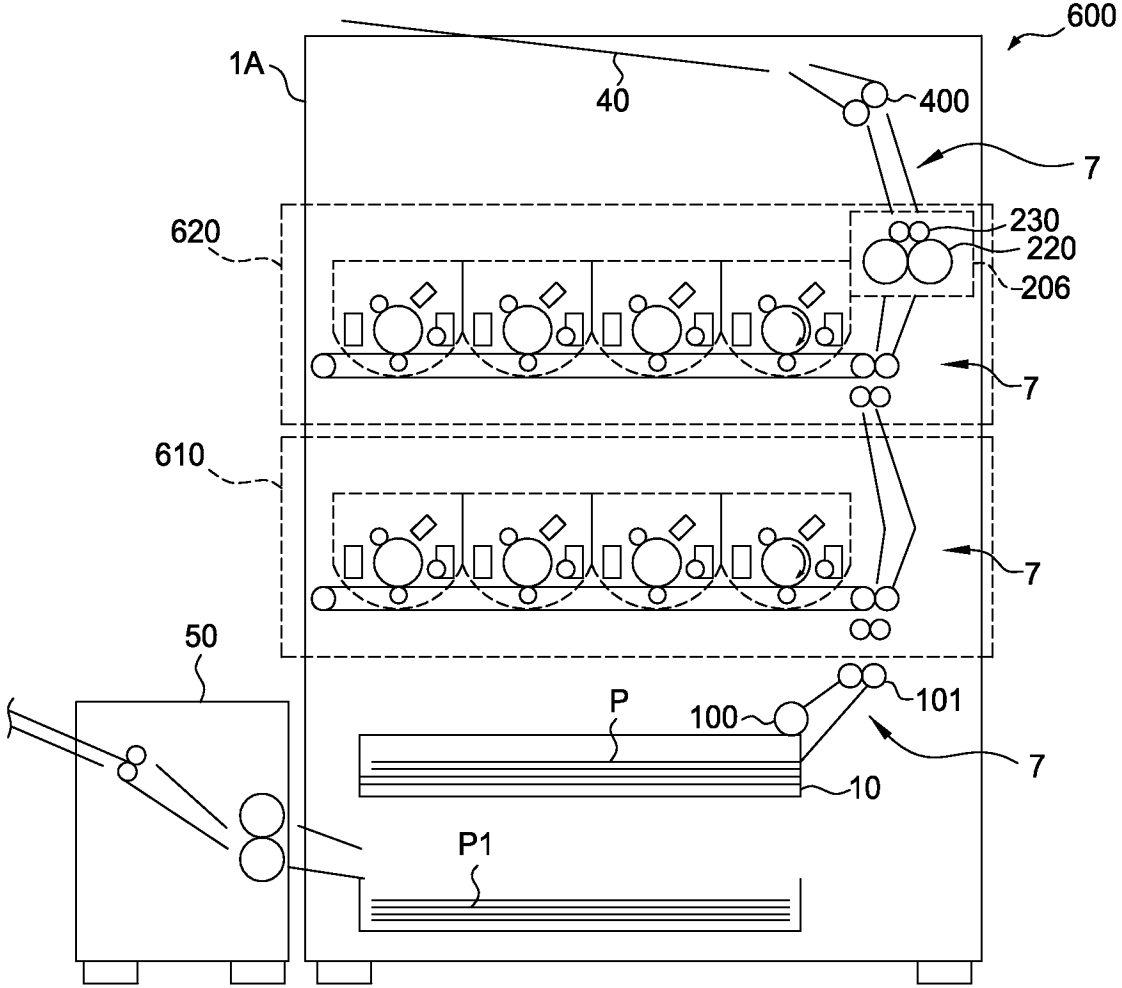
FIG. 6 is a schematic view of a configuration showing an image forming apparatus and a decolorization apparatus according to another embodiment.

Some embodiments employ a hybrid image-forming apparatus including a first electrographic image-forming unit that forms a thermally non-decolorable image and a second electrographic image-forming unit that forms a thermally decolorable image, each of the electrographic image-forming units being disposed on a common carrying path of the image-forming apparatus. One such embodiment is illustrated in FIG. 6, which is a schematic view of an image-forming apparatus 600 having a first image-forming unit 610, a second image-forming unit 620, and fixing device 206, each of which is disposed on carrying path 7 as shown. First image-forming unit 610 is an electrographic printer substantially similar to first printer 20 in FIG. 1, and is configured to form a non-decolorable color toner image on sheet P and/or a monochrome-only non-decolorable image on sheet P. Sheet P is taken out of cassette 10 by carrying roller pair 101 and transferred to first image-forming unit 610 and a non-decolorable image can be formed by first image-forming unit 610, as described above for first printer 20 in FIG. 1. Second image-forming unit 620 is an electrographic printer substantially similar to first image-forming unit 610, except that second image-forming unit 620 is configured to form a decolorable color toner image on sheet P and/or a monochrome-only decolorable image on sheet P. The decolorable image can be formed by second image-forming unit 620 using one or more erasable image-forming materials known in the art. In the embodiment illustrated in FIG. 6, second image-forming unit 620 is disposed on carrying path 7 between first image-forming unit 610 and fixing device 206. In other embodiments, first image-forming unit 610 may be disposed on carrying path 7 between second image-forming unit 620 and fixing device 206. In either configuration, fixing device 206 is used to fix images deposited on a sheet P by either first image-forming unit 610 or second image-forming unit 620. Fixing of color or monochromatic images on sheet P by fixing device 206 is carried out as described above in conjunction with FIG. 1.

An erasable image-forming material used by second image-forming unit 620 may include a color former containing crystal violet lactone, a developer, a first binder resin of styrene-butadiene copolymer, and a second binder resin of a styrene-based resin containing a-methylstyrene, where the first and second binder resins are in a compatible state. The color former may contain only crystal violet lactone, or may contain a second leuco dye in addition to the crystal violet lactone. A suitable second leuco dye is a fluorine-based leuco dye. Particularly suitable examples of black leuco dye include 2-anilino-6-(N-alkyl-N-alkylamino)-3-methylfluorane and derivatives thereof. Numerous other examples of suitable second leuco dyes are described in U.S. Patent Application Publication No. 2007/0072773, filed Sep. 18, 2006, which is incorporated by reference herein. Examples of the developer includes phenols, metal phenolates, carboxylic acids, metal carboxylates, benzophenones, sulfonic acids, metal sulfonates, phosphoric acids, metal phosphates, acidic phosphoric esters, acidic phosphoric ester metal salts, phosphorous acids, and metal phosphites. These developers can be used alone or in a combination of two or more species. The styrene-butadiene copolymer constituting the first binder resin preferably has a butadiene ratio of 5 to 15 wt %, and suitable examples of a styrene-based resin containing α-methylstyrene and constituting the second binder resin include:

α-methylstyrene resin,

α-methylstyrene-styrene copolymer,

α-methylstyrene-aliphatic copolymer,

α-methylstyrene-alicyclic copolymer,

α-methylstyrene-styrene-aliphatic terpolymer, and

α-methylstyrene-styrene-alicyclic copolymer.

Alternatively, an erasable image-forming material used by second image-forming unit 620 may include a color former, a developer, a binder resin and 0.5 wt % or less of a plasticizer. Examples of suitable materials for the color former include electron-donating organic compounds such as leucoauramines, diaryl phthalides, polyaryl carbinols, acyl auramines, aryl auramines, rhodamine B lactams, indolines, spiropyrans and fluorans. Examples of the developer include phenols, metal phenolates, metal carboxylates, benzophenones, sulfonic acids, sulfonates, phosphoric acids, metal phosphorares, acidic phosphates, metal acidic phosphates, phosphorous acids and metal phosphites. These may be used alone or in a mixture of two or more species. Examples of the plasticizer include phthalic acid derivatives, adipic acid derivatives, azelaic acid derivatives, sebacic acid derivatives, maleic acid derivatives, fumaric acid derivatives, trimellitic acid derivatives, citric acid derivatives, oleic acid derivatives, ricinoleic acid derivatives, sulfonic acid derivatives, phosphoric acid derivatives, glycerin derivatives, paraffin derivatives and diphenyl derivatives. Numerous additional examples of suitable materials for use as the color former, the developer, and the plasticizer are described in U.S. Patent Application Publication No. 2007/0072771, filed Sep. 18, 2006, which is incorporated by reference herein.

Images deposited on sheet P by either first image-forming unit 610 or second image-forming unit 620 are fixed thermally and with applied pressure using fixing device 206. In order to prevent decolorizable images formed by second image-forming unit 620 from being decolorized when sheet P passes through fixing device 206, an erasable image-forming material used by second image-forming unit 620 may be selected that has a decolorizing temperature that is significantly higher than the fixing temperature of images formed by first image-forming unit 610. For example, when the fixing temperature generated by fixing device 206 is 90-110° C., the erasable image-forming material selected for use by second image-forming unit 620 preferably has a decolorizing temperature of 130° C. to 140° C. In this way, decolorizable images formed by second image-forming unit 620 may be fixed by fixing device 206 without being decolorized.

In some cases, selection of erasable image-forming materials that have a decolorizing temperature greater than the fixing temperature of images formed by first image-forming unit 610 can be problematic. Consequently, in one embodiment, fixing device 206 is configured to fix images deposited by first image-forming unit 610 at a suitable fixing temperature, and to fix images deposited by second image-forming unit 620, which are decolorizable, at a lower temperature. Said lower temperature is specifically selected to be lower than the decolorizing temperature of the erasable image-forming material used by second image-forming unit 620 and higher than the fixing temperature of said erasable image-forming material. For example, in some embodiments, a selected erasable image-forming material has a fixing temperature of approximately 90-110° C. and a decolorizing temperature of approximately 120-140° C. In such embodiments, fixing device 206 is configured to fix images deposited on sheet P by second image-forming unit 620 at a fixing temperature of approximately 110° C., and to fix images deposited on sheet P by first image-forming unit 610 at the suitable temperature for such images, for example 120° C. or higher. In this way, a single fixing device 206 can be used to fix images non-decolorizable images deposited by first image-forming unit 610 and decolorizable images deposited by second image-forming unit 620. Furthermore, first image-forming unit 610, second image-forming unit 620, and fixing device 206 can be arranged on common carrying path 7 without endangering decolorizable images deposited by second image-forming unit 620.

In some embodiments, fixing device 206 is controlled by temperature control circuit 78 (shown in FIG. 2) to provide the different desired temperature, depending on which of first image-forming unit 610 or second image-forming unit 620 has been selected to form an image. In other respects, temperature control circuit 78 and fixing device 206 generally operate as described above in conjunction with FIG. 1.

While the foregoing is directed to embodiments of the present invention, other and further embodiments of the invention may be devised without departing from the basic scope thereof, and the scope thereof is determined by the claims that follow.

What is claimed is:

1. An image forming apparatus comprising:

a first electrographic image forming unit configured to form a first image on a first recording medium with a first material that is thermally non-decolorable;

a second electrographic image forming unit configured to form a second image on a second recording medium with a second material that is thermally decolorable; and a fixing unit which is on a common carrying path shared by the first recording medium and the second recording medium, which is configured to fix the first image to the first recording medium and to fix the second image to the second recording medium;

wherein a temperature of the fixing unit for fixing the first image and a temperature of the fixing unit for fixing the second image are lower than a decolorizing temperature of the second material.

2. The apparatus of claim 1, wherein the fixing unit is configured to fix the first image formed on the first recording medium by heating and pressing the first recording medium with a heat roller and a press roller.

3. The apparatus of claim 2, wherein the fixing unit is configured to fix the second image formed on the second recording medium by heating and pressing the second recording medium with the heat roller and the press roller.

4. The apparatus of claim 3, wherein the heat roller is maintained at a temperature less than the decolorizing temperature of the second material so that the temperature of the fixing unit is lower than the decolorizing temperature of the second material.

5. The apparatus of claim 1, wherein the fixing unit is configured to fix the second image formed on the second recording medium by heating and pressing the second recording medium with a heat roller and a press roller.

6. The apparatus of claim 1, wherein the first electrographic image forming unit is configured to form four color images, and the second electrographic image forming unit is configured to four color images.

7. The apparatus of claim 6, wherein the first electrographic image forming unit and the second electrographic image forming unit are tandem type units.

8. An image forming apparatus comprising:

a first electrographic printer configured to print a first image on a first recording medium with a first material that is thermally non-decolorable;

a second electrographic printer configured to print a second image on a second recording medium with a second material that is thermally decolorable; and a fixer, which is on a common carrying path shared by the first recording medium and the second recording medium, and is configured to fix the first image to the first recording medium and to fix the second image to the second recording medium;

wherein a temperature of the fixer during fixing of the first image and a temperature of the fixer during fixing of the second image are lower than a decolorizing temperature of the second material.

9. The apparatus of claim 8, wherein the fixer is configured to fix the second image formed on the second recording medium by heating and pressing the second recording medium with a heat roller and a press roller.

10. The apparatus of claim 9, wherein the heat roller is maintained at a temperature less than the decolorizing temperature of the second material so that the temperature of the fixer is lower than the decolorizing temperature of the second material.

11. The apparatus of claim 8, wherein the first electrographic printer and the second electrographic printer are tandem type printers.

12. The apparatus of claim 11, wherein the first electrographic printer and the second electrographic printer are a same size.

13. The apparatus of claim 12, wherein the first electrographic printer is disposed above the second electrographic printer.

14. The apparatus of claim 8, wherein the fixer is configured to fix the first image formed on the first recording medium by heating and pressing the first recording medium with a heat roller and a press roller.

15. An image forming method comprising:

forming a first image by a first electrographic method on a first recording medium with a first material that is thermally non-decolorable;

fixing the first image to the first recording medium while the first recording medium passes through a fixing unit;

forming a second image by a second electrographic method on a second recording medium with a second material that is thermally decolorable; and fixing the second image to the second recording medium while the second recording medium passes through the fixing unit;

wherein a temperature of the fixing unit for fixing the first image and a temperature of the fixing unit for fixing the second image are lower than a decolorizing temperature of the second material.

16. The method of claim 15, further comprising:

heating the second recording medium with the heat roller and pressing the second recording medium with the press roller.

17. The method of claim 16, further comprising:

maintaining the heat roller at a temperature less than the decolorizing temperature of the second material so that the temperatures of the fixing unit for fixing the first image and the second image are lower than the decolorizing temperature of the second material.

18. The method of claim 15, further comprising:

maintaining the heat roller at a temperature less than the decolorizing temperature of the second material so that the temperatures of the fixing unit for fixing the first image and the second image are lower than the decolorizing temperature of the second material.

* * * * *